US008469377B2

(12) United States Patent
Wilson et al.

(10) Patent No.: US 8,469,377 B2
(45) Date of Patent: Jun. 25, 2013

(54) TRUCK ASSEMBLY

(75) Inventors: Stephen S. Wilson, Las Vegas, NV (US); Bradley E. Wernli, Oceanside, CA (US)

(73) Assignee: Sbyke USA LLC, Las Vegas, NV (US)

( * ) Notice: Subject to any disclaimer, the term of this patent is extended or adjusted under 35 U.S.C. 154(b) by 0 days.

(21) Appl. No.: 13/346,923

(22) Filed: Jan. 10, 2012

(65) Prior Publication Data

US 2012/0104706 A1 May 3, 2012

Related U.S. Application Data

(62) Division of application No. 12/491,426, filed on Jun. 25, 2009.

(51) Int. Cl.
*A63C 17/01* (2006.01)

(52) U.S. Cl.
USPC ..... 280/87.042; 280/11.27; 280/11.28

(58) Field of Classification Search
USPC ..... 280/11.27, 11.28, 87.042; 16/35 D, 16/44; 74/567, 570.3
See application file for complete search history.

(56) References Cited

U.S. PATENT DOCUMENTS

| | | | | |
|---|---|---|---|---|
| 322,504 | A | 7/1885 | Thompson | |
| 329,556 | A | 11/1885 | Hirt | |
| 329,557 | A | 11/1885 | Hirt | |
| 537,689 | A | 4/1895 | Kouns | |
| 638,963 | A | 12/1899 | Ganswindt | |
| 865,441 | A | 9/1907 | Slocom | |
| 1,213,454 | A | 1/1917 | Brown | |
| 1,342,688 | A | 6/1920 | Heller et al. | |
| 1,548,973 | A | 8/1925 | Burleigh | |
| 1,599,223 | A | 9/1926 | Epps | |
| 1,607,972 | A | 11/1926 | Mangold | |
| 2,330,147 | A | 9/1943 | Rodriguez | |
| 2,583,858 | A * | 1/1952 | Kostolecki | 16/35 R |
| 3,203,706 | A | 8/1965 | Boyden | |
| 3,284,096 | A | 11/1966 | Hansen et al. | |

(Continued)

FOREIGN PATENT DOCUMENTS

| | | |
|---|---|---|
| AU | 610642 | 5/1991 |
| CN | 2501789 Y | 7/2002 |

(Continued)

OTHER PUBLICATIONS

Lee W. Young, Patent Cooperation Treaty, International Search Report, pp. 1-6.

(Continued)

*Primary Examiner* — Katy M Ebner
*Assistant Examiner* — Emma K Frick
(74) *Attorney, Agent, or Firm* — Stetina Brunda Garred & Brucker

(57) ABSTRACT

A truck assembly for a vehicle such as a skateboard or scooter may have a kingpin about which a hanger rotates. The hanger may be biased toward a caming surface having a depressed configuration by a spring, weight of the rider and also via a centrifugal force created during turning. This aids in dynamically stabilizing the truck assembly and the vehicle to which the truck assembly is mounted based on the particular rider and the maneuver being performed on the vehicle. The caming surface may have a regressive configuration such that the spring compresses at a different rate per degree of rotation of the hanger.

15 Claims, 8 Drawing Sheets

U.S. PATENT DOCUMENTS

| | | | | |
|---|---|---|---|---|
| 3,392,991 | A | 7/1968 | Ryan | |
| 3,442,528 | A | 5/1969 | Rademacher | |
| 3,652,101 | A | 3/1972 | Pivonka | |
| 3,860,264 | A | 1/1975 | Douglas et al. | |
| 3,891,225 | A | 6/1975 | Sessa et al. | |
| 3,924,292 | A * | 12/1975 | Christensen | 16/35 D |
| 3,992,029 | A | 11/1976 | Washizawa et al. | |
| 4,047,725 | A | 9/1977 | Pinchock | |
| 4,061,351 | A | 12/1977 | Bangle | |
| 4,082,307 | A | 4/1978 | Tait | |
| 4,103,921 | A | 8/1978 | Brooks | |
| 4,194,752 | A | 3/1980 | Tilch et al. | |
| 4,198,072 | A | 4/1980 | Hopkins | |
| 4,359,231 | A | 11/1982 | Mulcahy | |
| 4,469,343 | A | 9/1984 | Weatherford | |
| 4,526,390 | A | 7/1985 | Skolnik | |
| 4,624,469 | A | 11/1986 | Bourne | |
| 4,657,272 | A | 4/1987 | Davenport | |
| D289,985 | S | 5/1987 | Davenport | |
| D295,428 | S | 4/1988 | Cummings | |
| D295,989 | S | 5/1988 | Cummings | |
| D300,756 | S | 4/1989 | Cummings | |
| 4,863,182 | A | 9/1989 | Chern | |
| 5,046,747 | A | 9/1991 | Nielsen, Jr. | |
| 5,127,488 | A | 7/1992 | Shanahan | |
| 5,347,681 | A * | 9/1994 | Wattron et al. | 16/30 |
| 5,551,717 | A | 9/1996 | De Courcey | |
| 5,620,189 | A | 4/1997 | Hinderhofer | |
| 5,853,182 | A | 12/1998 | Finkle | |
| 5,931,738 | A | 8/1999 | Robb | |
| 5,975,546 | A * | 11/1999 | Strand | 280/87.042 |
| 6,220,612 | B1 | 4/2001 | Beleski, Jr. | |
| D444,184 | S | 6/2001 | Kettler | |
| 6,250,656 | B1 | 6/2001 | Ibarra | |
| 6,315,304 | B1 | 11/2001 | Kirkland et al. | |
| 6,318,739 | B1 | 11/2001 | Fehn | |
| 6,419,249 | B1 * | 7/2002 | Chen | 280/87.042 |
| 6,467,781 | B1 | 10/2002 | Feng | |
| 6,499,751 | B1 | 12/2002 | Beleski, Jr. | |
| 6,523,837 | B2 | 2/2003 | Kirkland | |
| 6,572,130 | B2 | 6/2003 | Greene et al. | |
| 6,595,536 | B1 | 7/2003 | Tucker | |
| 6,715,779 | B2 | 4/2004 | Eschenbach | |
| 6,739,606 | B2 | 5/2004 | Rappaport | |
| 6,942,235 | B2 | 9/2005 | Chang | |
| 7,007,957 | B1 | 3/2006 | Lee | |
| 7,044,491 | B2 | 5/2006 | Kettler et al. | |
| 7,140,621 | B2 * | 11/2006 | Cheng | 280/11.27 |
| 7,192,038 | B2 | 3/2007 | Tsai | |
| 7,195,259 | B2 * | 3/2007 | Gang | 280/87.042 |
| 7,540,517 | B2 | 6/2009 | Wernli | |
| 2004/0012166 | A1 | 1/2004 | Reginato | |
| 2005/0116430 | A1 | 6/2005 | Chen | |
| 2005/0139406 | A1 | 6/2005 | McLeese | |
| 2006/0042844 | A1 | 3/2006 | Kirkpatrick | |
| 2006/0049595 | A1 | 3/2006 | Crigler et al. | |
| 2008/0217085 | A1 | 9/2008 | Wernli | |
| 2009/0066150 | A1 * | 3/2009 | O'Rourke, Sr. | 301/5.23 |
| 2012/0217721 | A1 * | 8/2012 | O'Rourke | 280/220 |

FOREIGN PATENT DOCUMENTS

| | | | |
|---|---|---|---|
| DE | 4424297 | A1 | 1/1996 |
| FR | 2859111 | A1 | 3/2005 |
| FR | 2859166 | A1 | 3/2005 |
| GB | 2225990 | | 6/1990 |
| JP | 6254200 | A | 9/1994 |
| JP | 10211313A | A | 8/1998 |
| JP | 2006151032 | A | 6/2006 |

OTHER PUBLICATIONS

Triton, Triton Pro, Asa Products. Asa Products, Inc. Copyright 2004. 2 pages. <http://www.asaproducts.com/PhotoGallery.asp?ProductCode=Tri%2D001+Red>.

Wikipedia, "Caster Angle", http://en.wikipedia.org/wiki/Caster_angle; Oct. 10, 2009; 2 pages.

Mongoose Bikeboard; "Velocite Mongoose BikeBoard 24V"; http://bikeboardusa.com/velocite_Bike_Board_24V. asp; 2007; 2 pages.

Cave, Steve; "How to Replace Skateboard Bushings"; www.about.com/od/boardmaintenane/ss/replacebushings.htm (14 pages).

* cited by examiner

TRUCK ASSEMBLY

CROSS-REFERENCE TO RELATED APPLICATIONS

The present application is a divisional patent application of U.S. patent application Ser. No. 12/491,426, filed on Jun. 25, 2009, the entire contents of which are incorporated herein by reference.

STATEMENT RE: FEDERALLY SPONSORED RESEARCH/DEVELOPMENT

Not Applicable

BACKGROUND

The present invention relates to a suspension system (e.g., truck assembly) for a scooter, skateboard, and the like.

Prior art skateboard trucks are installed in the following manner. The base plate of the truck is attached to the underside of a deck of a skateboard. A kingpin extends from the base plate upon which the other components of the truck are mounted. A first elastomeric bushing is disposed about the kingpin and seated on the base plate. A hanger is then mounted on the elastomeric bushing. Additionally, the hanger has a protruding nose which mounts to a pivot bushing located in front of the kingpin. The hanger pivots about the protruding nose. A second elastomeric bushing is seated on the hanger. The first and second bushings and hanger assembly are tightened down with a washer and nut combination. The elastomeric bushings permit the hanger to pivot about the nose and pivot bushing. The elastomeric bushings bias the hanger back to the neutral position. The amount of bias may be adjusted by tightening or loosening the nut/washer combination on the kingpin. Unfortunately, prior art skateboard trucks provide limited pivoting motion since the elastomeric bushings must be tightly bolted to prevent the hanger from becoming loose. Also, the first and second elastomeric bushings must be somewhat rigid such that the hanger does not wiggle on the kingpin during operation. As such, the pivot range of prior art skateboard trucks is limited since the first and second bushings must have low elasticity and be relatively tight on the kingpin. As such, when the rider attempts to make a sharp left or right turn, the first and second elastomeric bushings may bottom out and inadvertently lift the outside wheels of the skateboard.

Additionally, a skateboard truck must be adjusted to fit the weight of the rider. A heavy rider would require a tighter setup compared to a lighter rider. For example, a lighter rider riding a skateboard setup for a heavy rider would have difficulty rolling the deck of the skateboard for turning since the setup for the truck assembly is too tight. Conversely, if the heavy rider rides a skateboard setup for a lighter rider, then the skateboard would be unstable since the truck setup would be too loose.

As discussed above, prior art skateboard trucks have a limited pivot range. Moreover, the truck setup must be individually adjusted for a narrow weight range of riders. As such, there is a need in the art for an improved truck.

BRIEF SUMMARY

The truck assembly shown and described herein addresses the issues discussed above, discussed below and those that are known in the art.

The truck assembly provides for a dynamically stabilized scooter or skateboard suspension system based on one or more of: 1) a weight of the rider, 2) a ramp profile of a caming surface, 3) turning radius, and 4) speed. These are not the only factors but other factors discussed herein may also aid in the dynamic stabilization feature of the truck assembly.

To this end, the truck assembly has a base and a hanger which is biased toward the base. The base incorporates one or more caming surfaces (preferably three caming surfaces). These caming surfaces may have a ramp profile that is linear, regressive, progressive or combinations thereof. Bearings are disposed between the hanger and the caming surfaces. Since the hanger is biased toward the base and the caming surfaces, the bearings are urged toward low middle portions of the caming surfaces in its neutral state. When the rider rolls the foot support to the left or right, the hanger rotates and the bearings ride up the ramp pushing the hanger further away from the base. Conversely stated, the base is urged up away from the hanger. When the truck assembly is attached to an underside of a foot support, the turning or yawing of the hanger lifts the base and the foot support away from the hanger. As the hanger rotates, the biasing member (e.g., compression spring, etc.) which biases the hanger toward the caming surfaces is increasingly compressed as the rider progresses through the turn. The amount that the spring or biasing member is compressed for each degree of angular rotation of the hanger can be custom engineered by designing the shape of the ramp profile of the caming surfaces. The ramp profile may be designed such that the spring increases in total deflection as the rider progresses through the turn but for each degree of angular rotation of the hanger, the change in spring deflection is reduced after passing an inflection region or throughout the turn. This illustrates a regressive ramp profile. As such, based on the ramp profile of the caming surfaces, the truck assembly may be dynamically stabilized as the rider progresses through the turn and comes out of the turn.

Additionally, the dynamic stabilization of the truck assembly is based on the weight of the rider. When the rider is not standing on the foot support, the spring biases the bearings back to the low middle portions of the caming surfaces. When the rider stands on the foot support, the bearings are urged toward the low middle portions of the caming surfaces due to the spring force of the spring but also the weight of the rider. Since the weight of each rider is different, the amount of biasing of the bearings toward the low middle portions of the caming surfaces is different for each rider. As such, the individual weight of each rider also dynamically stabilizes the truck assembly and custom fits the needs of each rider.

Centrifugal forces also dynamically stabilize the truck assembly. As the rider progresses through the turn, centrifugal forces increase based upon the then current turning radius and speed. The centrifugal forces increase a normal force applied to the foot support which increases the amount of bias that the bearings are urged toward the low middle portions of the caming surfaces.

As described herein, a vehicle for transporting a rider is provided. The vehicle may comprise a foot support and a truck. The foot support supports the rider and defines a longitudinal axis extending from a forward portion to an aft portion of the foot support. The foot support may roll about the longitudinal axis in left and right directions to effectuate left and right turns of the vehicle.

The truck which is attached to the foot support permits turning of the vehicle. The truck may comprise a body, a hanger and a sliding bearing. The body may have at least one caming surface which has a depressed configuration defining a low middle portion and raised outer portions. The hanger is biased toward the caming surface and is yawable between left and right yaw positions upon rolling the foot support about the longitudinal axis in the left and right directions. The hanger may be pivotable about a pivot axis which is skewed with respect to the longitudinal axis. The sliding bearing is disposed between the hanger and the caming surface. The hanger being biased against the sliding bearing also biases the sliding bearing against the caming surface and toward the low middle portion of the caming surface.

The vehicle may have one wheel non-pivotably disposed at a forward portion of the foot support.

The vehicle may further comprise a biasing member disposed adjacent to the hanger to bias the hanger toward the caming surface. The biasing member may be a spring or elastomeric disc. The vehicle may further comprise second and third caming surfaces which are symmetrically disposed about the pivot axis. Preferably, all three caming surfaces are symmetrically and rotationally disposed about the pivot axis.

A transverse cross section of the caming surface which has a groove configuration may be semi-circular. A radius of the semi-circular transverse cross section may be generally equal to a radius of the sliding bearing.

The depressed configuration of the caming surface may be linear, regressive, progressive from a low middle portion toward the raised outer portions.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
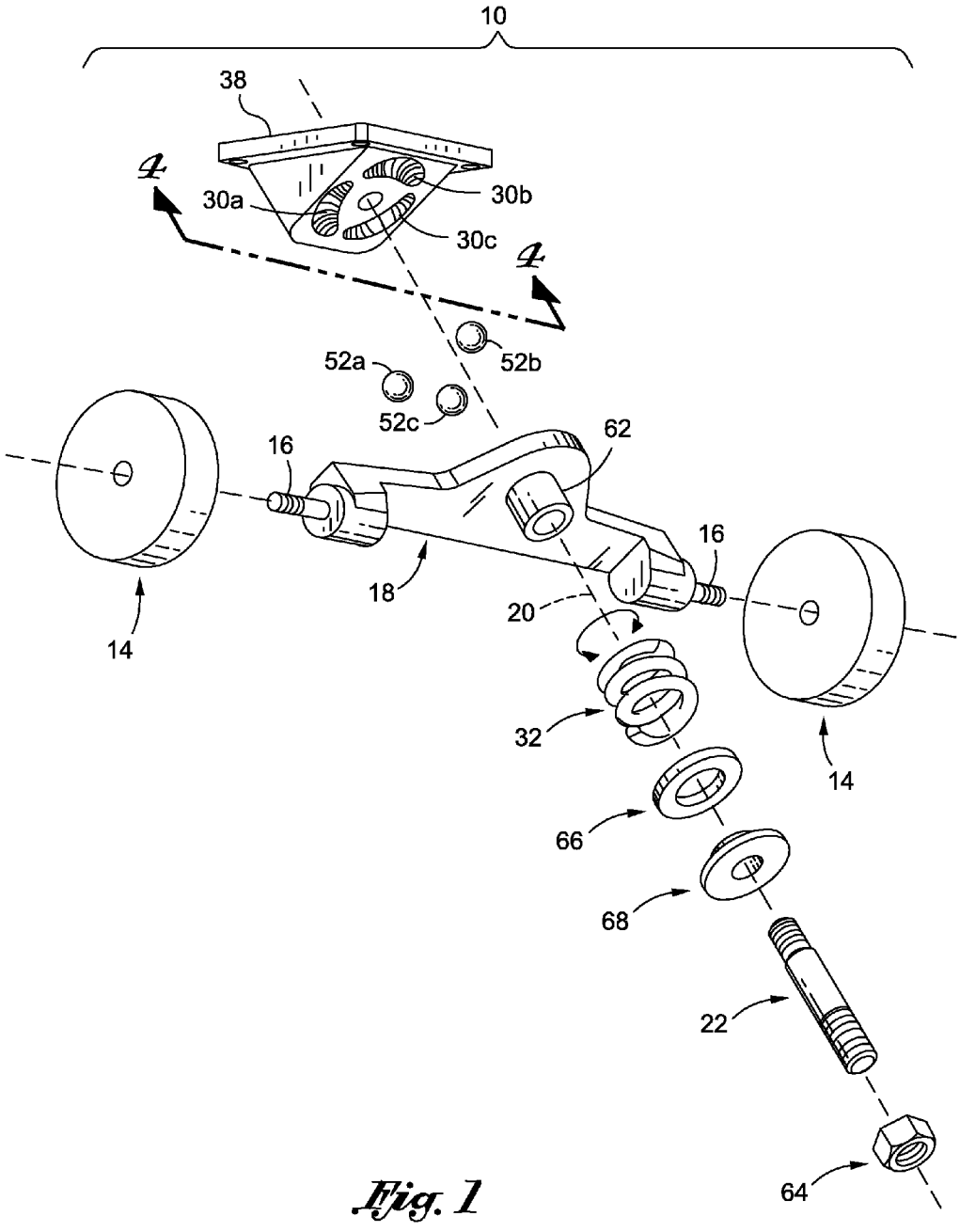
FIG. 1 is an exploded perspective view of a first embodiment of a truck assembly.

Referring now to FIG. 1, an exploded bottom perspective view of a truck assembly 10 for a vehicle 12 (see FIG. 3) such as a skateboard, scooter, etc. is shown. Wheels 14 are mounted to axels 16. The axel 16 is part of a hanger 18 which rotates about a pivot axis 20 defined by kingpin 22. The hanger 18 may have a wide yaw angle 24 (see FIG. 2) with respect to a transverse plane of a longitudinal axis 26 (see FIG. 2) of a foot support 28 to allow for a sharp or small turning radius for the vehicle 12. The sharp turning radius allows the rider of the vehicle 12 to experience a slalom like experience while making successive left and right turns. Also, the weight of the rider acts on a caming surface 30*a, b, c* to dynamically stabilize the vehicle 12 by using the weight of the rider to urge the hanger 18 back to its neutral straight forward position. Also, a spring 32 acts on the caming surface 30*a, b, c* to further stabilize the vehicle 12 and to urge the hanger 18 back to its neutral straight forward position.

Figure 2:
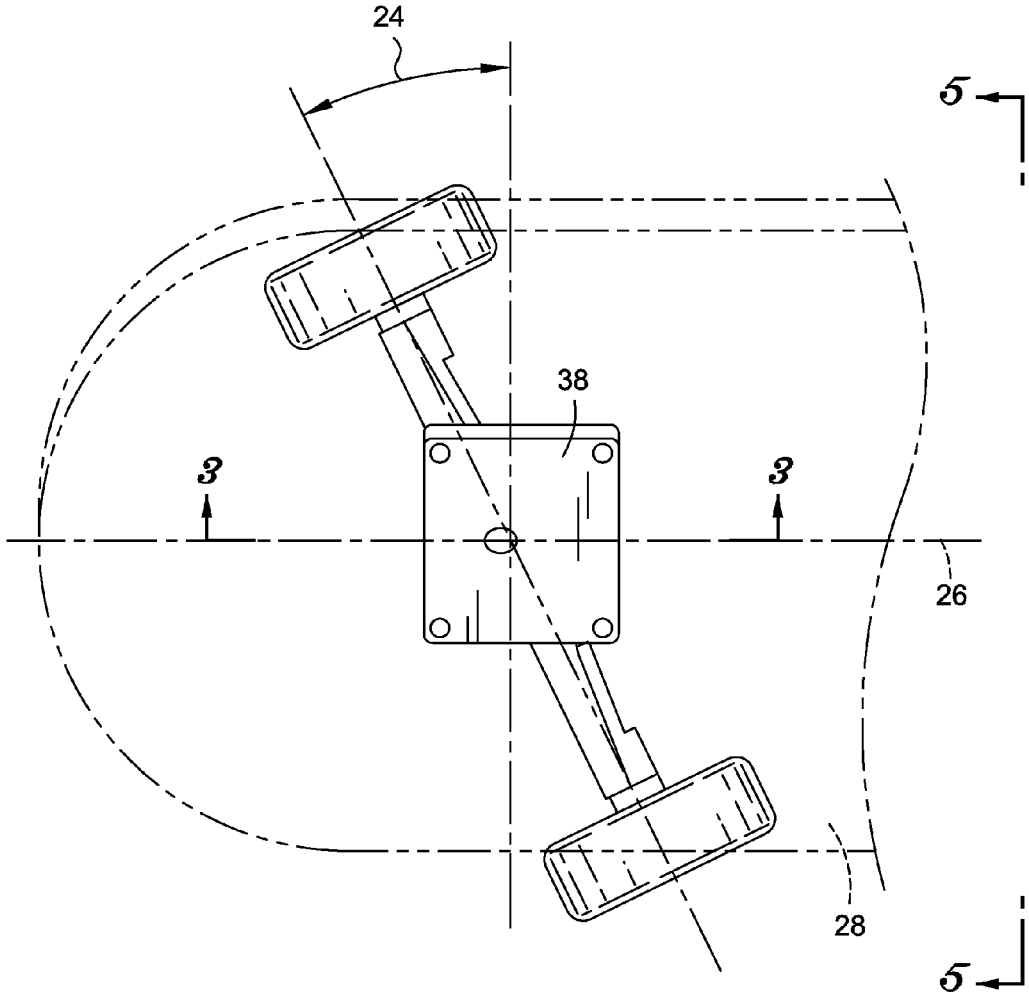
FIG. 2 is a top view of a vehicle with the truck assembly shown in FIG. 1 attached to an underside of a foot support wherein the foot support is rolled and the hanger of the truck assembly is yawed.
Figure 3:
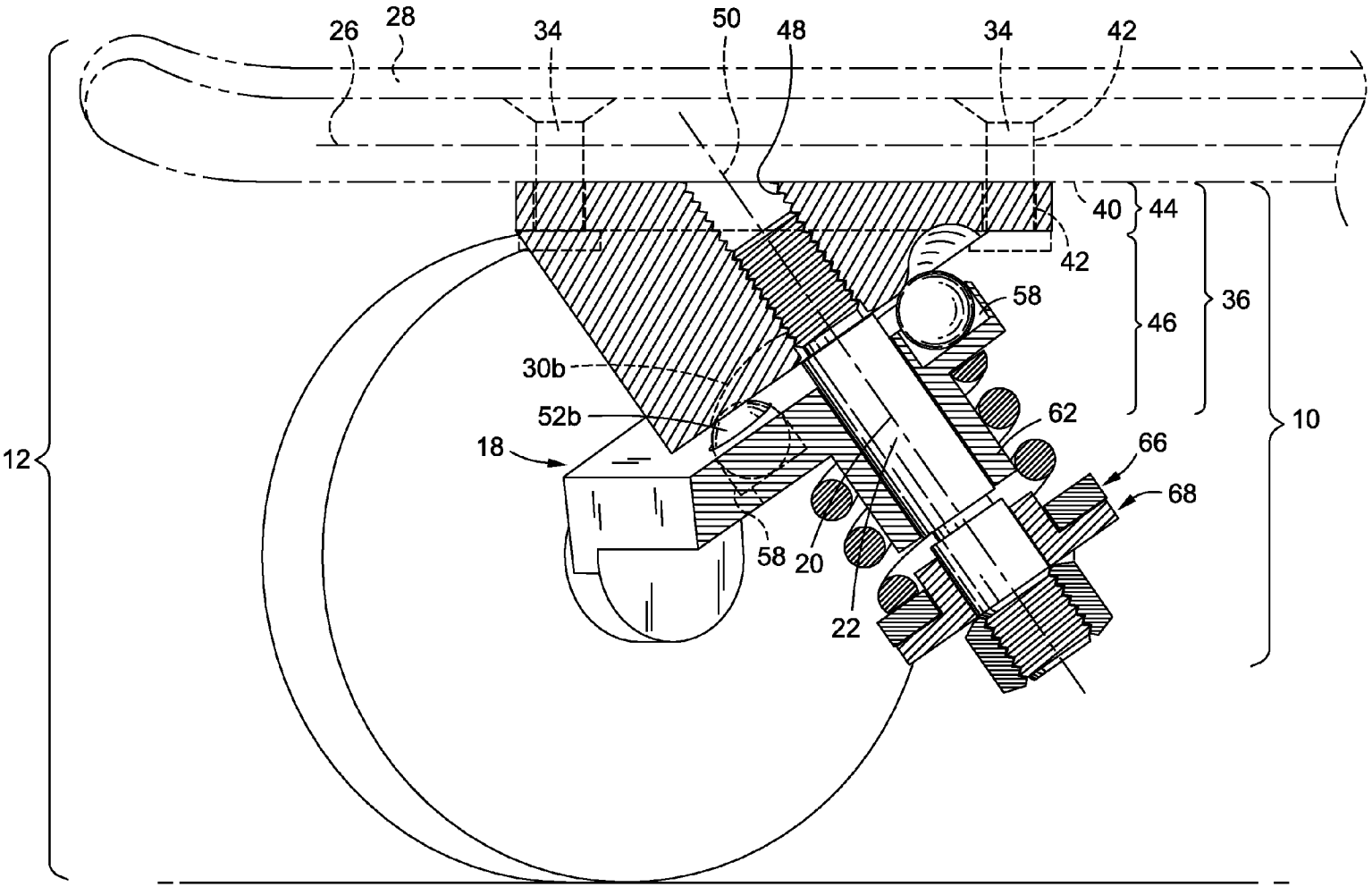
FIG. 3 is a cross sectional view of the truck assembly shown in FIG. 2.

Referring now to FIG. 3, the truck assembly 10 may be attached to the board or foot support 28 with a plurality of fasteners 34. The truck assembly 10 may have a base 36. The base 36 may have a flat upper surface 38 (see FIGS. 1 and 2) which mates with a flat lower surface 40 (see FIG. 3) of the foot support 28. The foot support 28 and the base 36 may have corresponding apertures 42 sized, configured and located such that the fasteners 34 (e.g., nut and bolt) may secure the truck assembly 10 to the foot support 28. The base 36 may have a plate section 44 (see FIG. 3) through which the apertures 42 are formed. The base 36 may additionally have a body section 46 (see FIG. 3) that extends downwardly from the plate section 44 when the base 36 is secured to the underside of the foot support 28.

The body section 46 and the plate section 44 may have a threaded hole 48 defining a first central axis 50. The kingpin 22 defines the pivot axis 20 of the hanger 18. The kingpin 22 may be attached to the threaded hole 48 so as to align the first central axis 50 and the pivot axis 20. The pivot axis 20 may be skewed with respect to the longitudinal axis 26 of the foot support 28 such that the hanger 18 yaws when the foot support 28 is rolled about the longitudinal axis 26 to the left or right. The pivot axis 20 is preferably within the same vertical plane as the longitudinal axis 26. The pivot axis 20 may be between about fifty (50) degrees to about twenty (20) degrees with respect to the longitudinal axis 26. For vehicles such as skateboards used in skateboard parks, the pivot axis 20 is closer to or is about fifty (50) degrees with respect to the longitudinal axis 26 to allow for tighter turns. For vehicles used in high speed down hill riding, the pivot axis 20 is closer to or is about twenty (20) degrees with respect to the longitudinal axis 26 to slow down the steering.

Figure 4:
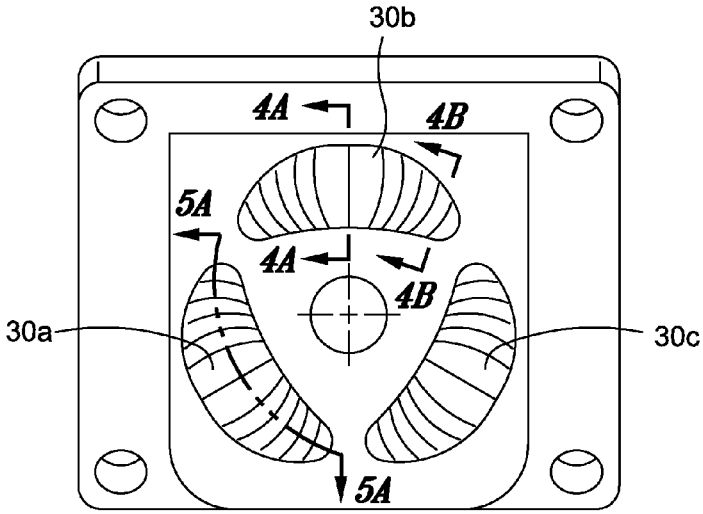
FIG. 4 is a bottom view of a base of the truck assembly shown in FIG. 1.
Figure 4A:
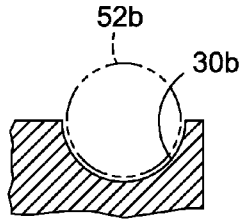
FIG. 4A is a first transverse cross sectional view of a caming surface shown in FIG. 4.
Figure 4B:
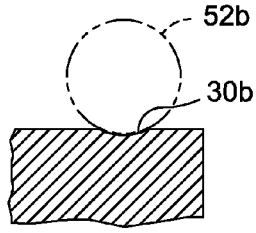
FIG. 4B is a second transverse cross sectional view of the caming surface shown in FIG. 4.
Figure 5A:
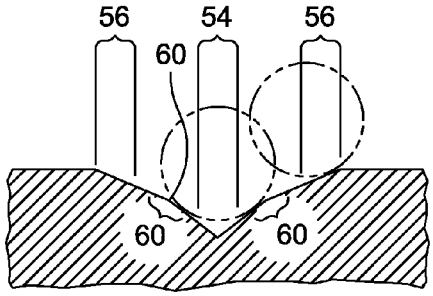
FIG. 5A is a cross sectional view of the caming surface shown in FIG. 4 illustrating a first embodiment of a ramp of the caming surface.

The body section 46 may additionally have two or more mirror shaped caming surfaces 30 (see FIG. 1). By way of example and not limitation, the drawings (see FIGS. 1 and 4) show three equidistantly spaced caming surfaces 30*a, b, c*. They 30*a, b, c* are symmetrically and rotationally spaced about the pivot axis 20. These caming surfaces 30*a, b, c* may be formed with a transverse semi-circular configuration that is generally equal to a radius of the spherical bearings 52*a, b, c*. The transverse configuration of the caming surface 30*b* is shown in FIGS. 4A and 4B. As such, the bearings 52*a, b, c*, which may be spherical, contact the caming surfaces 30*a, b, c* as a line. Each of the caming surfaces 30*a, b, c* may have a low middle portion 54 which is shown in FIG. 5A. FIG. 5A is a cross section of caming surface 30*a* (see FIG. 4). The other caming surfaces 30*b, c* may be identical to caming surface 30*a*. Each of the caming surfaces 30*a, b, c* may also have raised outer portions 56 (see FIG. 5A). From the low middle portion 54 to the raised outer portions 56, a ramp may be formed. The bearings 52*a, b, c* may be disposed between the hanger 18 and the caming surfaces 30*a, b, c*, as shown in FIGS. 1 and 3. The bearing and caming surface shown in FIG.

3 as hidden are bearing 52*b* (see FIG. 1) and caming surface 30*c* (see FIG. 1) to illustrate that there is a caming surface and bearing behind the cross sectional plane. The bearings 52*a, b, c* slide against the caming surfaces 30*a, b,c* as the hanger 18 yaws with respect to the longitudinal axis 26. They 52*a, b, c* are also seated within depressions 58 formed in the hanger 18 (see FIG. 3). The sliding bearings 52*a, b, c* slide on the caming surfaces 30*a, b, c*. They 52*a, b, c* generally do not roll on the caming surfaces 30*a, b, c*. There may be slight rolling. However, predominantly, the sliding bearings 52*a, b, c* slide against the caming surfaces 30*a, b, c*. It is also contemplated that a different bearing mechanism may be employed. By way of example and not limitation, the bearing mechanism may roll along the caming surfaces 30*a, b, c* and also roll on an opposing caming surface formed on the hanger 18.

Figure 5B:
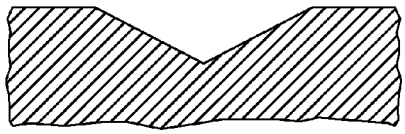
FIG. 5B illustrates a second embodiment of a ramp of the caming surface.
Figure 5C:
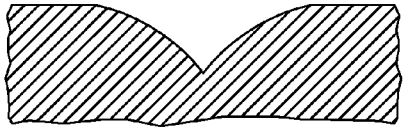
FIG. 5C illustrates a third embodiment of a ramp of the caming surface.

Referring now to FIGS. 5A-5C, the ramp configuration of the caming surfaces 30*a, b, c* may be curved, linear or combinations thereof. The ramp may start linear from the lower middle portion 54 then transition to a regressive configuration. An inflection region 60 may be located between the low middle portion 54 and the raised outer portion 56. The regressive configuration may provide less lift per degree of hanger 18 rotation after the inflection region 60 compared to before the inflection region 60. This is shown in the ramp profile of the caming surface 30*a* in FIG. 5A. The inflection region 60 may be a point or may be gradual such that the rider does feel a dramatic shift in slopes. The other caming surfaces 30*b, c* may be identical to caming surface 30*a*.

Other caming surface profiles are also contemplated. By way of example and not limitation, FIGS. 5B and 5C show a linear profile and a curved regressive profile, respectively. In FIG. 5B, the slope of the ramp is linear from the low middle portion 54 outward to the raised outer portions 56. For each degree of rotation of the hanger 18 about the pivot axis 20, the spring 32 is deflected the same amount throughout the turn. In FIG. 5C, the slope of the ramp is progressively regressive from the low middle portion 54 to the raised outer portions 56. Beginning from the low middle portion 54, for each degree of angular rotation of the hanger 18 about the pivot axis 20, the spring 32 is deflected less as the rider goes deeper into the turn or as the rider fully enters the turn. When the rider is fully into the turn, the yaw angle 24 of the hanger 24 is at its maximum for the particular turn. When the rider comes out of the turn, the spring relaxes more and more until the rider is headed straight forward again.

The regressive nature of the caming surfaces 30*a, b, c* allow the rider to have a different feel as the rider progresses into and through the turn. Initially, as the rider rolls the foot support 28 about the longitudinal axis 26, the bearings 52*a, b, c* slide against the caming surfaces 30*a, b, c*. As the rider turns, centrifugal forces are produced which increasingly push the hanger 18 and caming surfaces 30*a, b, c* together. The spring 32 also compresses. For the profile shown in FIG. 5A, the spring force initially increases at a linear rate per degree of rotation of the hanger 18. After the inflection region 60 (see FIG. 5A), the caming surface 30*a* regresses. Thereafter, for each degree of rotation of the hanger, the spring is deflected less than prior to the inflection region 60. This provides a different feel for the rider as he/she progresses into and through the turn.

Other ramp profiles are contemplated such as a combination of the ramp profiles shown in FIGS. 5A-5C. By way of example and not limitation, the ramp profile may be linear from the low middle portion 54 to the inflection region 60. After the inflection region 60, the ramp profile may be progressively regressive as shown in FIG. 5C. Although only regressive ramp profiles have been illustrated, the ramp profiles may also be progressive either linearly or curved (e.g., exponentially).

When there are three caming surfaces 30*a, b, c*, the hanger 18 may rotate about pivot axis 20 about plus or minus fifty degrees (+/−50°). Other angles of rotation are also contemplated such as plus or minus sixty degrees (+/−60°) or less than fifty degrees (<50°). When there are two caming surfaces, the hanger 18 may rotate up to about plus or minus one hundred eighty degrees (+/−180°). When there are four caming surfaces, the hanger 18 may rotate up to about plus or minus ninety degrees (+/−90°).

The hanger 18 may be elongate. Axels 16 may be coaxially aligned and extend out from opposed sides of the elongate hanger 18. The hanger 18 may additionally have a post 62 which guides the spring 32. With the spring 32 about the post 62, the spring 32 biases the hanger 18 and the bearings 52*a, b, c* toward the caming surfaces 30*a, b, c*, as shown in FIG. 3. The hanger 18 does not typically contact the body section 46 directly. Rather, the sliding bearings 52*a, b, c* are disposed within the depressions 58 and slides along the caming surfaces 30*a, b, c* as the hanger 18 yaws left and right.

Figure 6:
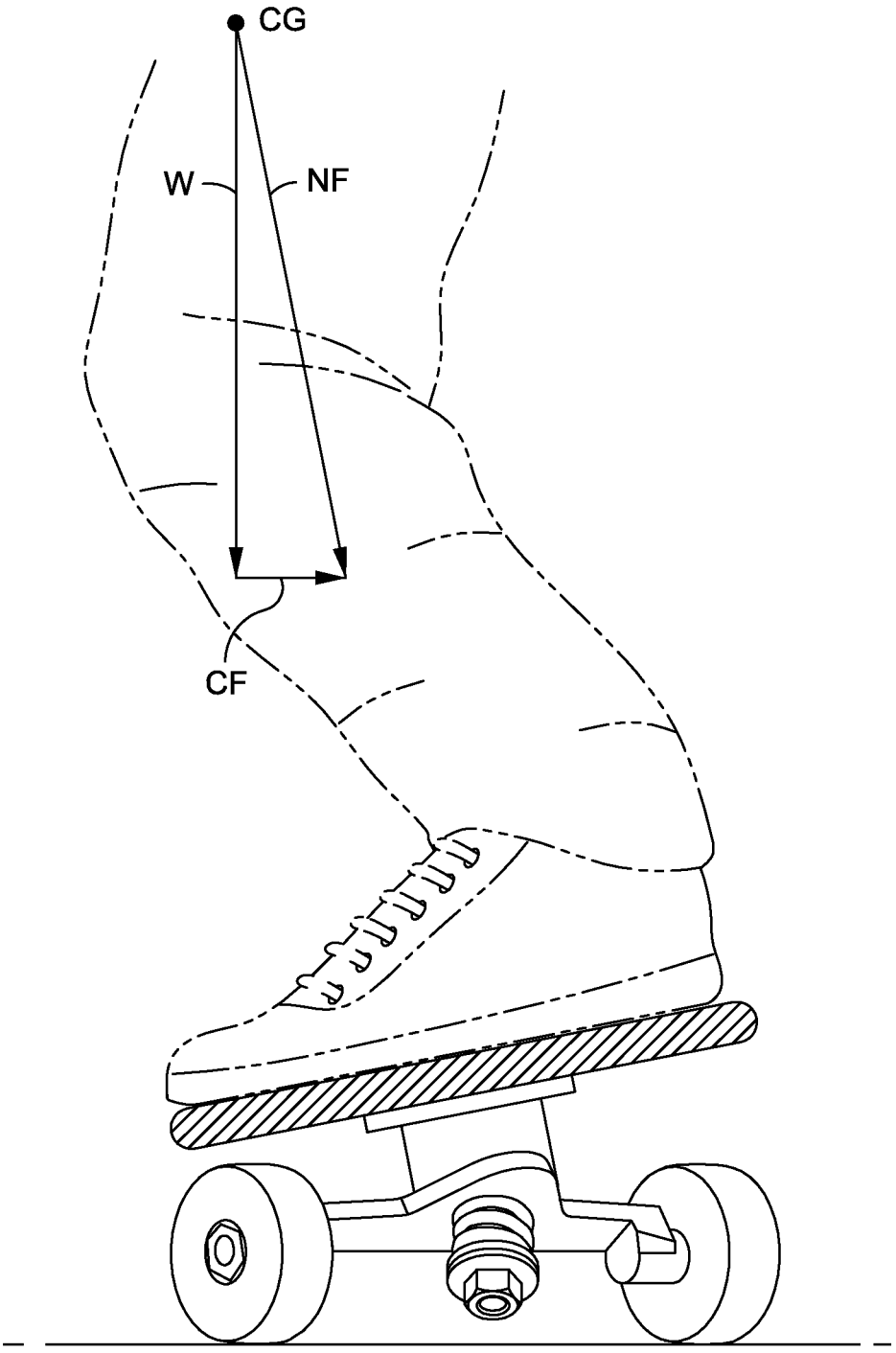
FIG. 6 illustrates an increased normal force imposed upon the foot support of the vehicle due to a centrifugal force.

When the rider is not standing on the foot support 28, the hanger 18 is in the neutral position wherein the vehicle 12 would roll straight forward. The sliding bearings 52*a, b, c* are urged toward the low middle portions 54 of the caming surfaces 30*a, b, c* by the spring 32 as shown in FIG. 3. As the rider rides the vehicle 12, the rider may roll (see FIG. 2) the foot support 28 about the longitudinal axis 26 to the right or to the left. When the foot support 28 is urged to the left or right, the hanger 18 is yawed in a corresponding direction, as shown in FIG. 2. The sliding bearings 52*a, b, c* slide toward the raised outer portions 56 of the caming surfaces 30*a, b, c*. Simultaneously, the sliding bearings 52*a, b, c* push the hanger 18 back upon the spring 32 so as to compress the spring 32. The compression of the spring 32 increases the spring force that attempts to urge the sliding bearings 52*a, b, c* back to the low middle portions 54 of the caming surfaces 30*a, b, c*. Additionally, the force of the rider normal to the deck of the vehicle also increases as the rider makes left and right turns due to a centrifugal force which is shown in FIG. 6. CG is the center of gravity of the rider. W is the weight of the rider. CF is the centrifugal force due to turning. NF is the increased resultant force applied to the deck or foot support due to weight of the rider and centrifugal force. The cumulative force on the foot support due to (1) the weight of the rider and (2) centrifugal forces increases during turns so as to further urge the sliding bearings 52*a, b, c* back to the low middle portions 54 of the caming surfaces 30*a, b, c*. The compression of the spring 32, the regressive profile of the caming surfaces 30*a, b, c* and/or the increased normal force on the foot support 28 dynamically increases the stability of the vehicle 12.

As mentioned above, the weight of the rider dynamically stabilizes the vehicle 12 and operation the truck assembly 10. In particular, each rider weighs a different amount. As such, the normal force acting on the foot support 28 of the vehicle 12 due to the weight of the rider is different for each rider. The sliding bearings 52*a, b, c* are urged toward the low middle portion 54 of the caming surfaces 30*a, b, c* to a different amount in light of the weight of the rider. For lighter riders, the cumulative force urging the sliding bearings 52*a, b, c* toward the low middle portions 54 of the caming surfaces 30*a, b, c* is less than that of heavier riders. Moreover, when the rider is turning left and right, the normal force of the rider acting on the foot support 28 varies based on the turning radius, speed of the vehicle 12 and the weight of the rider. Different centrifugal forces are created based on these variables. As such, the truck assembly 10 dynamically stabilizes the vehicle based on the weight of the particular rider. Also, the truck assembly setting (i.e., spring 32 preload setting) can accommodate a wider range of rider weights since the stability of the vehicle 12 and operation of the truck is not solely dependent upon the spring but also dynamically dependent on the weight of the rider and/or other factors.

From the foregoing discussion, the truck is dynamically stabilized by compression of the spring 32 due to (1) the sliding bearings 52*a, b, c* sliding up toward the raised outer portions 56 of the caming surfaces 30*a, b, c* that has a regressive ramp profile, (2) the weight of the rider and (3) also the turn radius during riding. As such, the truck assembly 10 provides a multi faceted and dynamically stabilized suspension system.

A tension nut 64 (see FIGS. 1 and 3) may be threaded onto a threaded distal end portion of the kingpin 22. The tension nut 64 may adjust the preload on the spring 32. The kingpin 22 and the tension nut 64 hold the truck assembly 10 together.

Additionally, a bearing 66 capable of supporting an axial load (e.g., thrust bearing, needle thrust bearing, angular contact bearing, tapered roller bearing, etc.) may be disposed between the tension nut 64 and the spring 32. The purpose of the thrust bearing 66 is to decouple the spring 32 from the retainer 68 and tension nut 64 from rotation of the hanger 18 such that the tension nut 64 does not loosen or vibrate off during operation. It is contemplated that the tension nut 64 may also be glued or affixed to the kingpin 22 to prevent rotation or loosening of the tension nut 64 from both repeated yawing action of the hanger 18 and also vibration during operation.

The kingpin 22 may be threaded to the threaded hole 48. The hanger 18 is disposed about the kingpin 22. The spring 32 is disposed about the post 62 of the hanger 18 and the kingpin 22. The thrust bearing 66, retainer 68 and tension nut 64 are mounted to the kingpin 22. The tension nut 64 is tightened onto the kingpin 22 to adjust the preload force the spring 32 imposes on the truck assembly 10.

The truck assembly 10 may be attached to a skateboard. It is contemplated that one truck assembly 10 is attached to the forward portion of the skateboard deck. Also, one truck assembly 10 is attached to the aft portion of the skateboard deck. Alternatively, the truck assembly 10 may be attached to a scooter having a handle wherein the rider stands upon the foot support 28 and steadies the vehicle 12 or scooter with the handle. One truck assembly 10 may be attached to the forward portion of the foot support 28. Also, one truck assembly 10 may be attached to the aft portion of the foot support 28. Alternatively, it is contemplated that the forward portion of the foot support 28 may have a single unitary wheel similar to that of a RAZOR (i.e., scooter).

Additionally, the truck assembly 10 may be attached to a scooter as shown in U.S. patent application Ser. No. 11/713,947 ('947 application), filed on Mar. 5, 2007, now U.S. Pat. No. 7,540,517, the entire contents of which is expressly incorporated herein by reference. By way of example and not limitation, the truck assembly 10 may be attached to the aft portion of the scooter shown in the '947 application. A front wheel which does not pivot may be attached to the forward portion of the scooter. During operation of the device, the rider will stand on the foot support 28. To effectuate a left turn, the rider will shift his/her weight to supply additional pressure to the left side of the foot support 28. The foot support 28 will roll about the longitudinal axis 26 to the left side. The kingpin 22 is at a skewed angle with respect to the longitudinal axis 26 such that the hanger 18 yaws with respect to the longitudinal axis 26 upon rolling of the foot support. The left wheel moves forward and the right wheel moves to the rear. This will swing the rear of the foot support 28 to the right to turn the vehicle or scooter to the left. The truck assembly 10 discussed herein provides for a wide angular yaw 24 such that the rider is capable of achieving sharp or small radius turns. To effectuate a right turn, the rider will shift his/her weight to supply additional pressure to the right side of the foot support 28. The foot support 28 will roll about the longitudinal axis 26 to the right side. The hanger 18 yaws with respect to the longitudinal axis 26. The right wheel moves forward and the left wheel moves to the rear. This will swing the rear of the foot support 28 to the left to turn the vehicle or scooter to the right. The amount of wide angular yaw 24 that the truck assembly 10 is capable of is due to the unique structure discussed herein. As such, the rider is capable of achieving sharper turns. When the left and right turns are combined in a fluid motion, the sharp, small radius turns in the left and right directions provide a slalom like experience to the rider. As the hanger 18 yaws to the right, the spring compresses upon the weight of the rider then decompresses to return the hanger 18 back to its neutral position. The rider then applies pressure to the left side of the foot support 28 to effectuate a left turn. The spring compresses upon the weight of the rider. As the rider comes out of the left turn, the spring decompresses to return the hanger back to its neutral position.

In an aspect of the truck assembly 10, although a compression coil spring is shown and described in relation to the truck assembly 10, it is contemplated that the spring 32 may be replaced or used in combination with other types of spring elements such as an elastomeric disc or the like.

Figure 7:
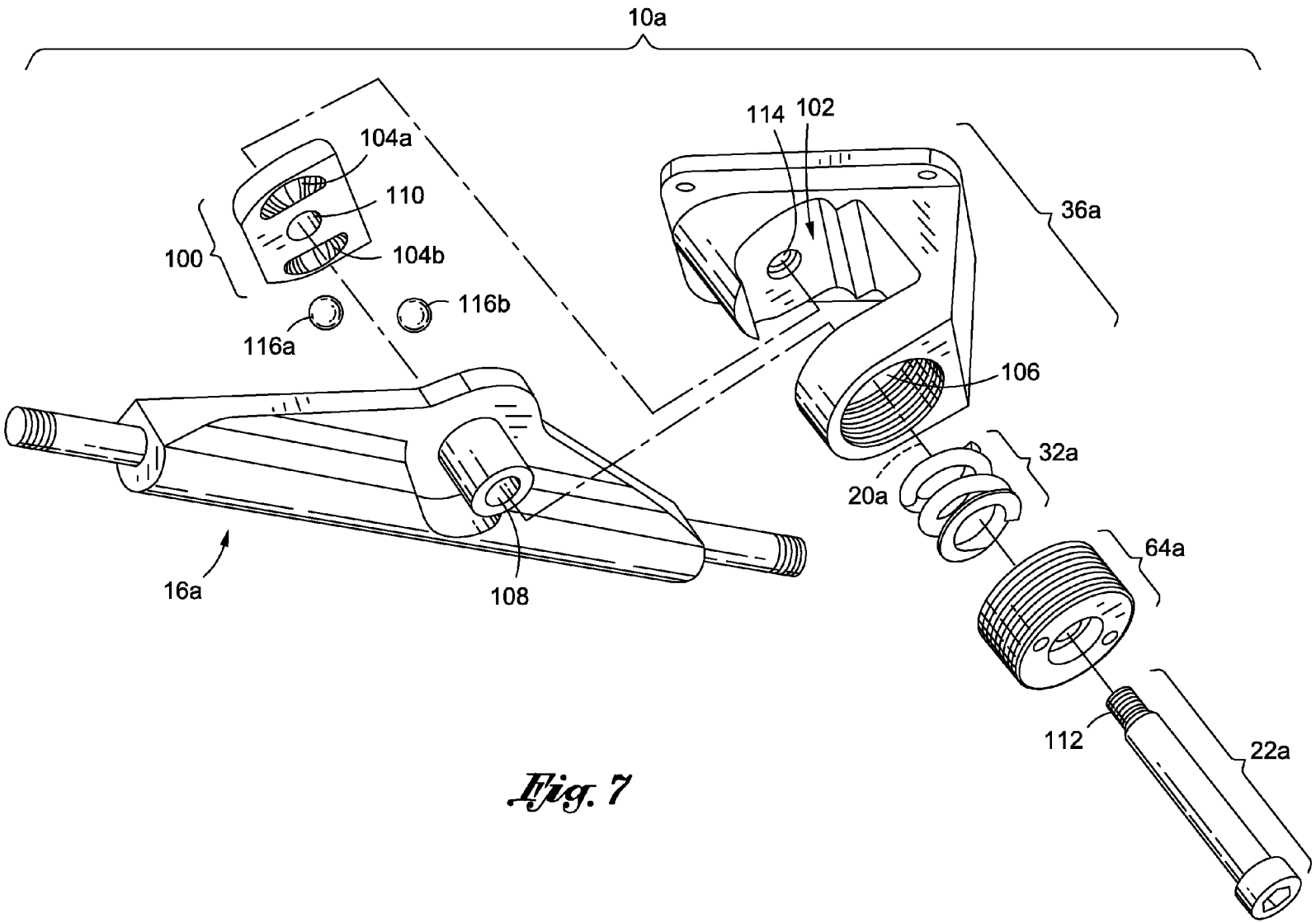
FIG. 7 is an exploded perspective view of a second embodiment of a truck assembly.
Figure 8:
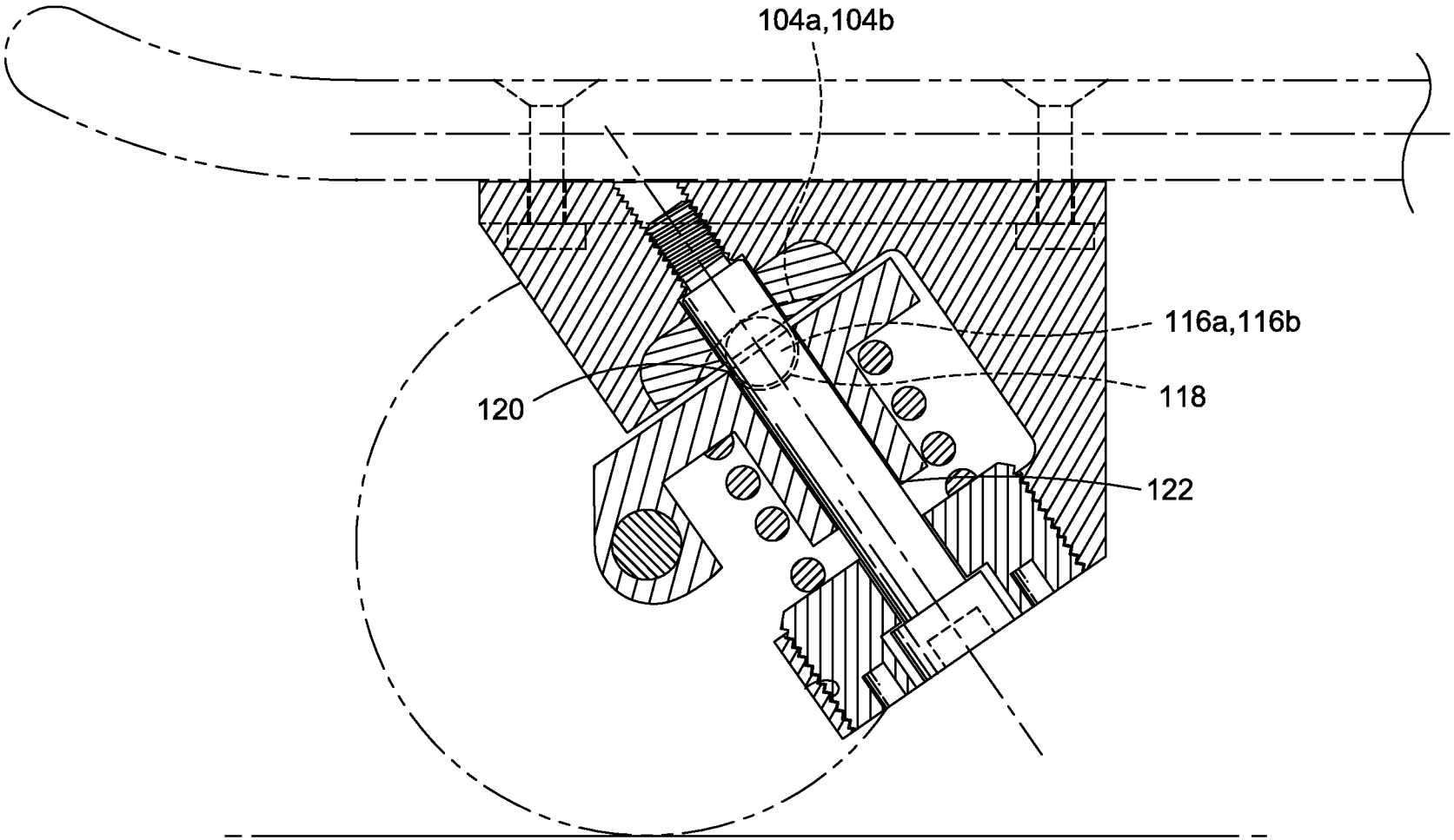
FIG. 8 is a cross sectional view of the truck assembly shown in FIG. 7 when assembled.

Referring now to FIGS. 7 and 8, a second embodiment of the truck assembly 10*a* is shown. The truck assembly 10*a* may have a base 36*a* that is attachable to an underside of a foot support 28. The truck assembly 10*a* is also dynamically stabilized and functions identical to the embodiment shown in FIGS. 1-6. However, the embodiment shown in FIGS. 7 and 8 is assembled in a slightly different manner. An insert 100 is disposed within a recess 102 formed in the base 36*a*. The insert 100 has two caming surfaces 104*a, b*. The caming surfaces 104*a, b* are symmetrical about the pivot axis 20*a*. To assemble the truck assembly 10*a* shown in FIGS. 7 and 8, the tension nut 64*a* is disposed about the kingpin 22*a*. The spring 32*a* is placed in contact with the tension nut 64*a* and disposed about the kingpin 22*a*. This assembly is inserted through the aperture 106 of the base 36*a*. The hanger 18*a* and the insert 100 are disposed within the base 36*a* and aligned to the kingpin 22*a*. The kingpin 22*a* is inserted through the aperture 108 of the hanger 18*a* and an aperture 110 of the insert 100. The threads 112 of the kingpin 22*a* are threadingly engaged to a threaded hole 114 of the base 36*a*. At some point in time, the bearings 116*a, b* are disposed between the insert 100 and the hanger 18*a*. As shown in FIG. 8, the bearings 116*a, b* are biased toward the caming surfaces 104*a, b* and disposed within a depression 118. The preload on the spring 32*a* may be adjusted by screwing the tension nut 64*a* more into the base 36*a* or out of the base 36*a*.

Although the two caming surface 104*a, b* embodiment shown in FIGS. 7 and 8 is a suitable truck assembly 10*a*, preferably, there is at least three caming surfaces 30*a, b, c* as shown in the embodiment shown in FIGS. 1-6. The reason is that the additional caming surfaces balance a load that the hanger 18 places on the kingpin 22 when there are three or more caming surfaces symmetrically disposed about the pivot axis 20. In the embodiment shown in FIGS. 7 and 8, the hanger tends to apply greater pressure or force on the kingpin at locations 120, 122 (see FIG. 8). The force that the hanger

18*a* places on the kingpin 22*a* at locations 120, 122 is greater for the embodiment shown in FIGS. 7 and 8 compared to the embodiment shown in FIGS. 1-6 due to the embodiment shown in FIGS. 7 and 8 having only two caming surfaces compared to the embodiment shown in FIGS. 1-6 which incorporates three caming surfaces 30*a, b, c*. It is also contemplated that the angular orientation of the caming surfaces 104*a, b* or caming surfaces 30*a, b, c* may be disposed about the pivot axis 20, 20*a* at any angular orientation. However, the orientation as shown in the drawings is preferred. In particular, the caming surfaces 104*a, b* are disposed on lateral sides for the embodiment shown in FIGS. 7 and 8. For the caming surfaces 30*a, b, c* shown in FIGS. 1-6, the caming surface 30*b* is disposed or aligned to a vertical plane defined by a longitudinal axis 26. The other caming surfaces 30*a, c* are disposed symmetrically about the pivot axis 20 in relation to caming surface 30*b*.

Figure 9:
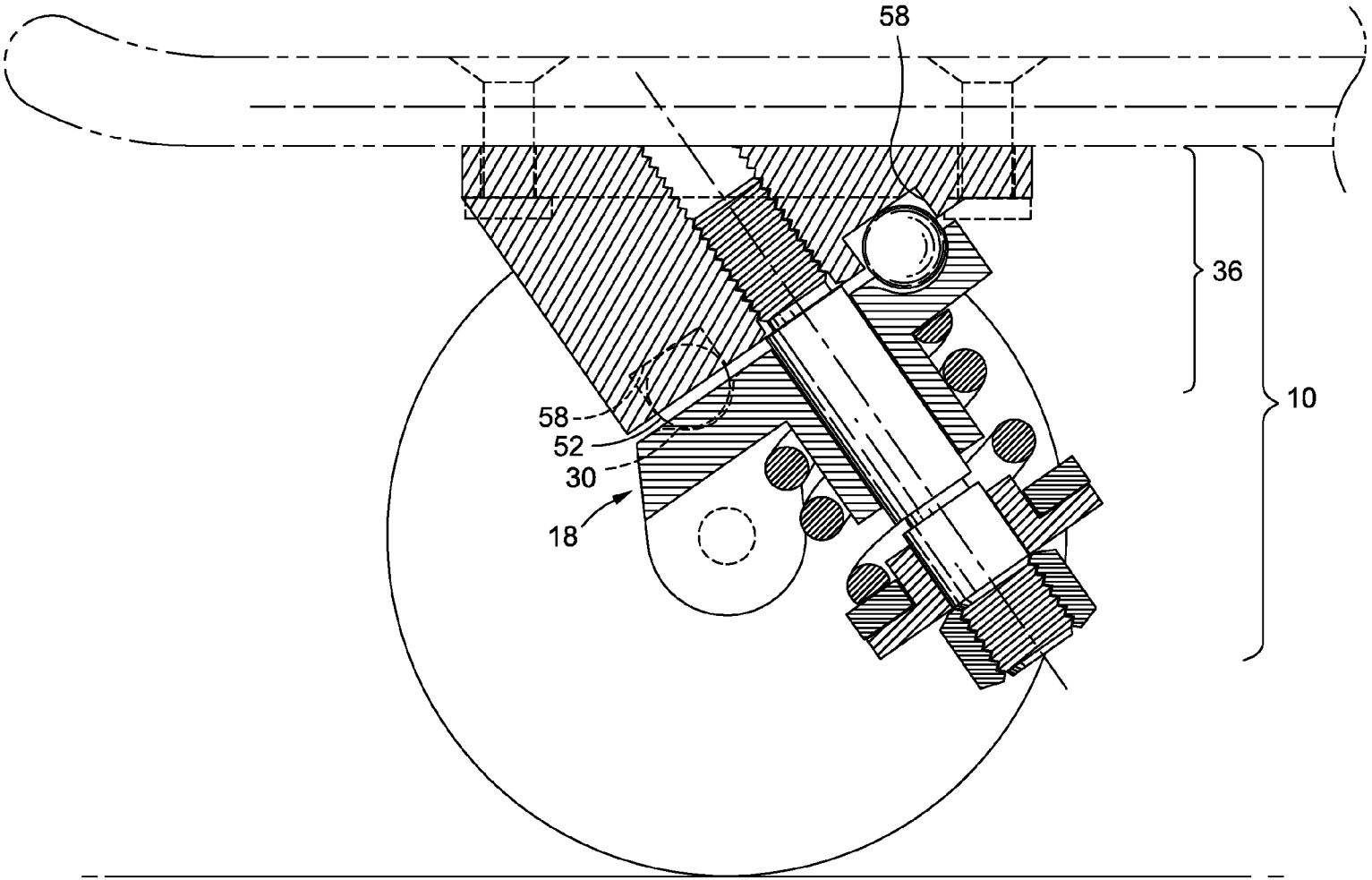
FIG. 9 is an illustration of the truck assembly wherein the caming surface is formed on a hanger of the truck assembly.

Referring now to FIG. 9, an alternative arrangement for the truck assembly 10 is shown. In FIGS. 1-8, the caming surface 30 is formed in the base 36 and the bearings 52 are seated in the depressions 58 of the hanger 18. FIG. 9 illustrates the alternative wherein the caming surface 30 is formed in the hanger 18 and the bearings 52 are seated in depressions 58 formed in the base 36.

The above description is given by way of example, and not limitation. Given the above disclosure, one skilled in the art could devise variations that are within the scope and spirit of the invention disclosed herein, including various ways of securing the truck assembly 10 to the foot support 28. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of stabilizing a vehicle during turns, the method comprising the steps of:

attaching a truck assembly to an aft portion of a foot support of the vehicle;

rolling the foot support about a longitudinal axis of the foot support;

yawing an axle of a hanger of the truck assembly having two wheels mounted to opposed end portions of the axle about a pivot axis which is skewed with respect to the longitudinal axis, the axle being oriented traverse to the longitudinal when the vehicle is moving straight forward;

during the yawing step, traversing a bearing up away from a low middle portion of a camming surface toward a raised outer portion of the camming surface wherein the bearing is disposed between a base of the truck and the hanger, the camming surface is formed in either the base of the truck or the hanger, and the camming surface has a curved groove defined by a recession between an inner curve and an outer curve with respect to the pivot axis and defines a curved travel path of the bearing equidistant to the pivot axis; and biasing the hanger and the base toward each other such that the bearing is biased toward the low middle portion to stabilize the vehicle.

2. The method of claim 1 wherein the traversing step includes the step of sliding the bearing on the camming surface.

3. The method of claim 2 wherein the bearing has a spherical ball configuration, and the traversing step includes the step of sliding the spherical ball bearing within the curved groove.

4. The method of claim 1 wherein the traversing step includes the step of traversing, the bearing within a recessed camming surface.

5. The method of claim 4 wherein the traversing step includes the step of traversing the bearing within a curved groove defining the curved travel path equidistant to the pivot axis.

6. The method of claim 1 wherein the traversing step includes the step of traversing the bearing along the curved travel path equidistant to the pivot axis.

7. The method of claim 1 wherein the rolling step comprises the step of applying foot pressure to either the left or right sides of the foot support.

8. The method of claim 7 further comprising the step of balancing the foot pressure and a biasing force of the biasing step.

9. The method of 1 wherein the biasing step is dynamically accomplished based on a turning radius and speed of the scooter.

10. The method of claim 1 wherein the yawing step includes the step of yawing the hanger of the truck assembly about the pivot axis which is between about 20 degrees to about 50 degrees skewed with respect to the longitudinal axis.

11. The method of claim 1 wherein the yawing step includes the step of yawing the axle of the truck assembly about the pivot axis which is between about 20 degrees to about 50 degrees with respect to the longitudinal axis.

12. A method of stabilizing a vehicle during turns, the method comprising the steps of:

attaching a truck assembly to an aft portion of a foot support of the vehicle;

rolling the foot support about a longitudinal axis of the foot support;

yawing an axle of a hanger of the truck assembly having two wheels mounted to opposed end portions of the axle about a pivot axis which is skewed with respect to the longitudinal axis, the axle being oriented traverse to the longitudinal when the vehicle is moving straight forward;

during the yawing step, traversing a bearing away from a low middle portion of the camming surface toward a raised outer portion of the camming surface wherein the bearing is disposed between as base of the truck and the hanger and the camming surface is formed in either the base of the truck or the hanger, the caming surface has a curved groove defined by a recession between an inner curve and an outer curve with respect to the pivot axis; and biasing the hanger and the base toward each other such that the hanger is biased toward the low middle portion of the camming surface to stabilize the scooter.

13. The method of claim 12 wherein the rolling step comprises the step of applying foot pressure to either the left or right sides of the foot support.

14. The method of claim 13 further comprising the step of balancing the foot pressure and a bias force of the biasing step.

15. The method of claim 12 wherein the biasing step is dynamically accomplished based on a turning radius and speed of the scooter.

* * * * *